US005657392A

United States Patent [19]

Bouchard

[11] Patent Number: 5,657,392

[45] Date of Patent: Aug. 12, 1997

[54] MULTI-WAY SPEAKER WITH A CABINET DEFINING A MIDRANGE DRIVER PYRAMIDAL COMPARTMENT

[75] Inventor: Gilbert Bouchard, Boisbriand, Canada

[73] Assignee: Electronique Messina Inc., Blainville, Canada

[21] Appl. No.: 552,292

[22] Filed: Nov. 2, 1995

[51] Int. Cl.[6] ..... H04R 1/02

[52] U.S. Cl. ..... 381/90; 181/145; 381/188; 381/159

[58] Field of Search ..... 381/90, 89, 159, 381/158, 188, 205, 186; 181/145, 147, 199

[56] References Cited

U.S. PATENT DOCUMENTS

| | | | |
|---|---|---|---|
| D. 281,316 | 11/1985 | Gary . | |
| D. 305,892 | 2/1990 | Freed . | |
| D. 427,067 | 6/1992 | Kohan | D14/207 |
| 3,608,665 | 9/1971 | Driai . | |
| 3,666,041 | 5/1972 | Engelhardt | 181/145 |
| 3,912,866 | 10/1975 | Fox . | |
| 4,033,430 | 7/1977 | Bolden . | |
| 4,147,229 | 4/1979 | Flashman . | |
| 4,179,585 | 12/1979 | Herrenschmidt . | |
| 4,200,170 | 4/1980 | Williams . | |
| 4,231,446 | 11/1980 | Weiss et al. . | |
| 4,249,037 | 2/1981 | Dexter . | |
| 4,475,620 | 10/1984 | Carlsson . | |
| 4,787,472 | 11/1988 | Minnerath et al. . | |
| 4,984,653 | 1/1991 | Spors . | |
| 5,025,885 | 6/1991 | Froeschle . | |
| 5,086,871 | 2/1992 | Barbe . | |
| 5,123,500 | 6/1992 | Malhoit et al. . | |
| 5,266,752 | 11/1993 | Cussans . | |

OTHER PUBLICATIONS

Bose Technology Makes the Difference.

Cinema DSP Technical Information—Third Edition—Yamaha, pp. 1–22.

Promotional Sheet by Messina Electronics.

*Primary Examiner*—Curtis Kuntz

*Assistant Examiner*—Ping W. Lee

[57] ABSTRACT

A three-way speaker comprises a high frequency transducer, a mid-frequency transducer, a low frequency transducer, and a hollow speaker cabinet defining a pyramidal mid-frequency transducer compartment and a low frequency transducer compartment isolated from the mid-frequency transducer compartment. The high frequency transducer is mounted in a first hole of the cabinet opening in the low frequency transducer compartment, the mid-frequency transducer is mounted in a second hole of the cabinet opening in the mid-frequency transducer compartment, and the low frequency transducer is mounted in a third hole of the cabinet opening in the low frequency transducer compartment. Therefore, the isolated mid-frequency transducer compartment and low frequency transducer compartment also isolates the mid-frequency transducer from a displacement of air produced by the low frequency transducer in the low frequency transducer compartment. This prevents the mid-frequency transducer to produce distortion caused by this displacement of air. Also, the pyramidal mid-frequency transducer compartment improves the performance of the mid-frequency transducer in the frequency range 150–1500 Hz.

5 Claims, 3 Drawing Sheets

MULTI-WAY SPEAKER WITH A CABINET DEFINING A MIDRANGE DRIVER PYRAMIDAL COMPARTMENT

BACKGROUND OF THE INVENTION

1. Field of the Invention

The present invention relates to a multi-way speaker of which the cabinet defines a separate compartment for isolating the mid-frequency transducer from the low frequency transducer of the speaker.

2. Brief Description of the Prior Art

Conventional prior art three-way speakers comprise a rectangular cabinet as well as a low frequency transducer, a mid-frequency transducer, and a low frequency transducer respectively mounted in respective circular holes opening in a common compartment of the rectangular cabinet. A drawback of this construction is that distortion is produced by the mid-frequency transducer in response to the displacement of air generated by the low frequency transducer in the common compartment.

OBJECTS OF THE INVENTION

An object of the present invention is to provide a multi-way speaker in which the mid-frequency transducer is isolated from the low frequency transducer.

Another object of the present invention is to mount the mid-frequency transducer of a multi-way speaker into an isolated pyramidal compartment to improve the frequency range performance of that mid-frequency transducer.

SUMMARY OF THE INVENTION

More particularly, in accordance with the present invention, there is provided a multi-way speaker comprising (a) a set of transducers including a mid-frequency transducer, and a low frequency transducer, and (b) a hollow speaker cabinet structure defining a mid-frequency transducer compartment, a low frequency transducer compartment isolated from the mid-frequency transducer compartment, a first hole opening in the mid-frequency transducer compartment for receiving the mid-frequency transducer, and a second hole opening in the low frequency transducer compartment for receiving the low frequency transducer.

In operation, the isolated mid-frequency transducer compartment and low frequency transducer compartment isolates the mid-frequency transducer from a displacement of air produced by the low frequency transducer in the low frequency transducer compartment to thereby overcome the above discussed drawback of the prior art.

In accordance with a preferred embodiment of the multi-way speaker according to the instant invention, the mid-frequency transducer compartment is a pyramidal compartment defining an apex situated generally behind the mid-frequency speaker.

In accordance with another preferred embodiment of the multi-way speaker of the invention:

the hollow speaker cabinet structure comprises an enclosure wall means, and an inner partition means mounted within the enclosure wall means for dividing the hollow speaker cabinet structure into the mid-frequency transducer compartment and the low frequency transducer compartment;

the enclosure wall means presents the general configuration of a parallelepiped and defines an inner corner, and the inner partition means comprises a triangular wall applied in the inner corner to define the mid-frequency transducer pyramidal compartment;

the enclosure wall means comprises first, second and third walls perpendicular to each other to form the inner corner, and the triangular wall comprises a first beveled edge surface applied to an inner face of the first wall, a second beveled edge surface applied to an inner face of the second wall, and a third beveled edge surface applied to an inner face of the third wall;

the multi-way speaker is a three-way speaker and the set of transducers further comprises a high frequency transducer, the hollow speaker cabinet structure further comprising a third hole opening in the low frequency transducer compartment for receiving the high frequency transducer; and the multi-way speaker further comprises a crossover circuit for supplying an audio signal to the mid-frequency transducer and the low frequency transducer, and the crossover circuit comprises means for supplying to the mid-frequency transducer frequency components of the audio signal situated in the frequency range 150–1500 Hz, and means for supplying to the low frequency transducer frequency components of the audio signal situated in the frequency range 0–150 Hz.

The objects, advantages and other features of the present invention will become more apparent upon reading of the following non restrictive description of a preferred embodiment thereof, given by way of example only with reference to the accompanying drawings.

DETAILED DESCRIPTION OF THE PREFERRED EMBODIMENT

Figure 1:
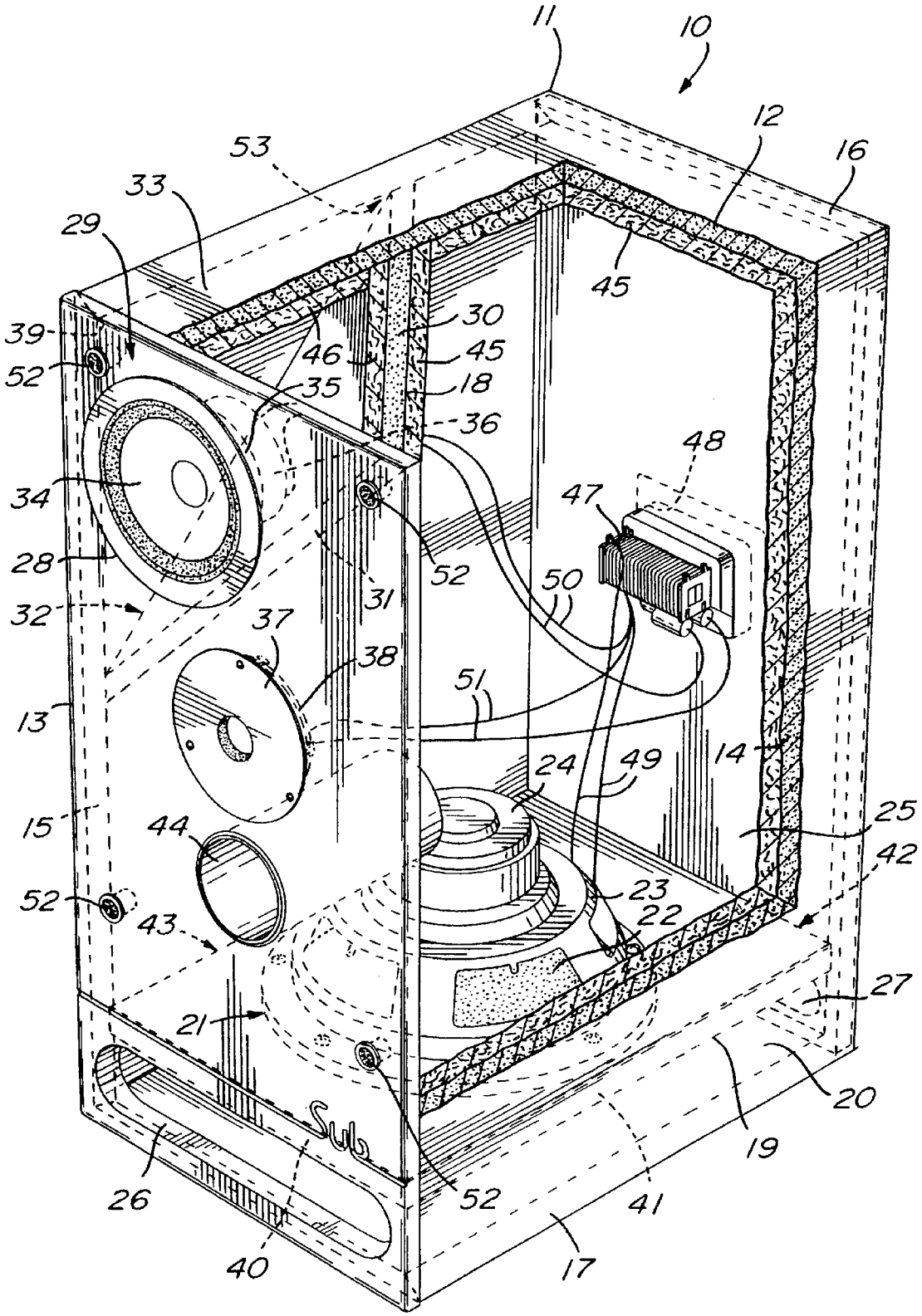
FIG. 1 is a front, partially broken perspective view of a three-way speaker embodying the present invention, comprising a pyramidal compartment for isolating the mid-frequency transducer.
Figure 2A:
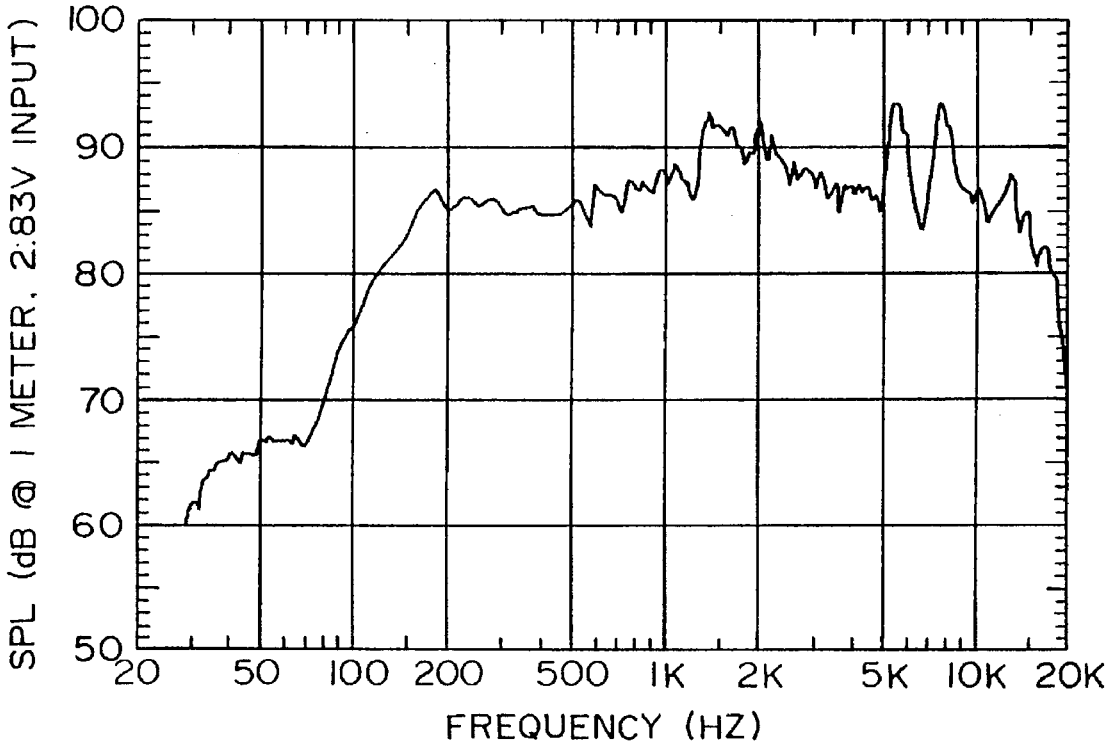
FIG. 2*a* is a graph showing, in the frequency range 20–20 k Hz, the level of sound versus frequency produced by a speaker having a given transducer and a rectangular cabinet of given volume in response to an input signal of 2.83 volts, the level of sound being measured at a distance of 1 meter in front of the speaker and on the axis of the transducer.
Figure 2B:
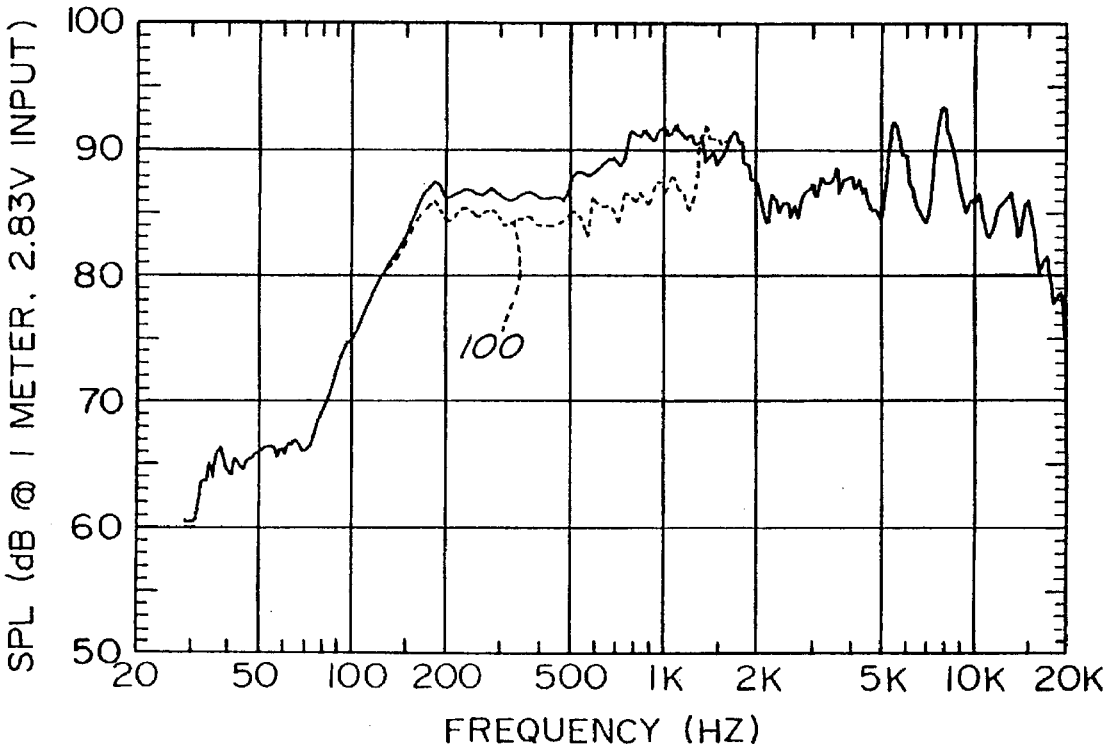
FIG. 2*b* is a graph showing, in the frequency range 20–20 k Hz, the level of sound versus frequency produced by a speaker comprising the same transducer but a pyramidal cabinet having substantially the same volume in response to the same input signal of 2.83 volts, the level of sound being measured at a distance of 1 meter in front of the speaker and on the axis of the tranducer.
Figure 3:
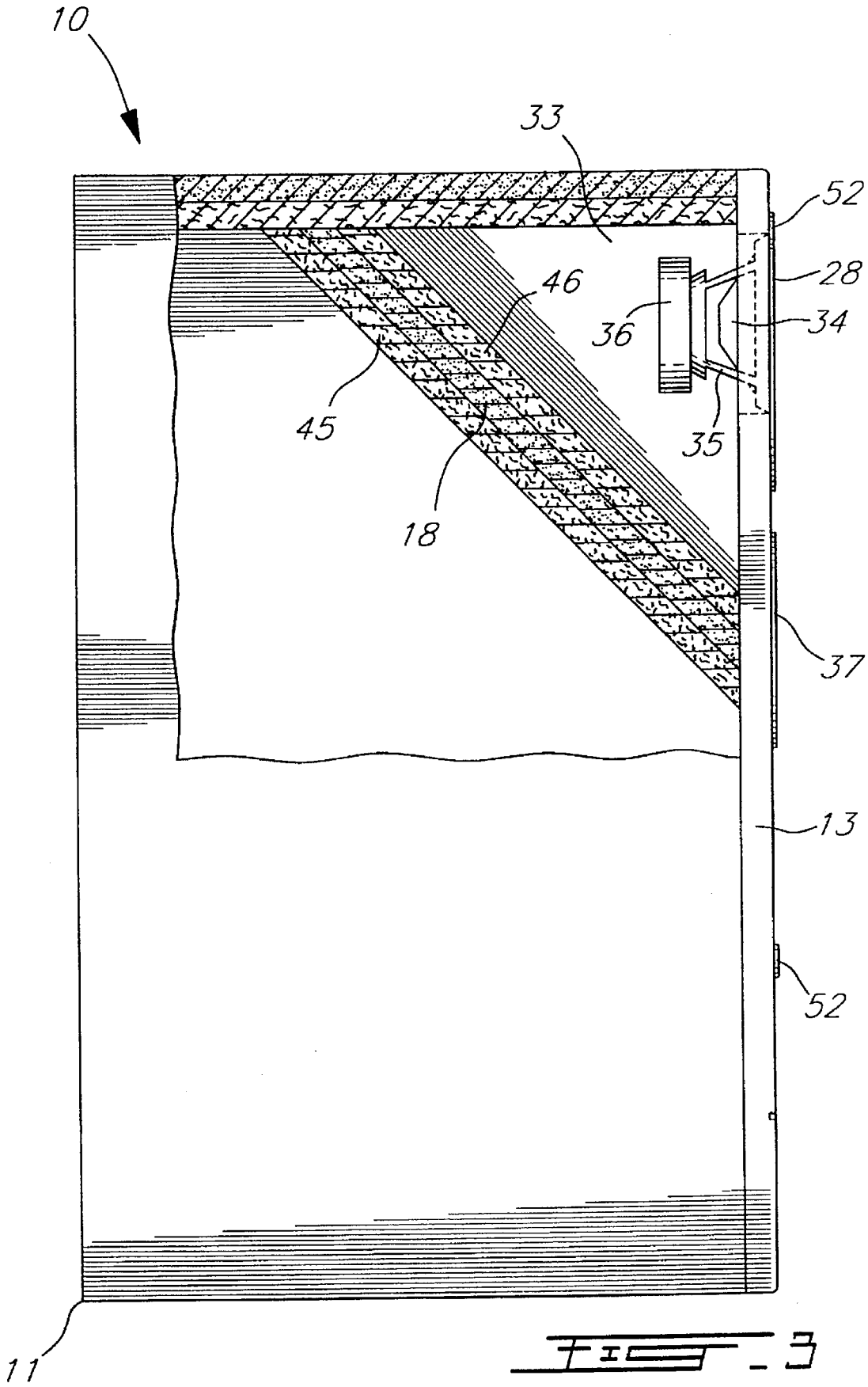
FIG. 3 is a partially broken, side elevational view of the three-way speaker of FIG. 1, showing the pyramidal compartment and the mid-frequency transducer.

The preferred embodiment of the speaker in accordance with the present invention is generally identified by the reference 10 in FIGS. 1 and 3 of the appended drawings. Although the present invention will be described hereinafter with reference to a three-way speaker, it should be kept in mind that the concept of the invention also applies to a two-way speaker including a mid-frequency transducer and a low frequency transducer.

As illustrated in FIGS. 1 and 3, the speaker 10 comprises a cabinet 11. As can be seen, the cabinet 11 forms a hollow speaker cabinet structure presenting the general configuration of a parallelepiped.

More specifically, the cabinet 11 defines an enclosure wall means formed by a rectangular horizontal top wall 12, a rectangular vertical front wall 13, a rectangular vertical left side wall 14, a rectangular vertical right side wall 15, a rectangular vertical rear wall 16, and a rectangular horizontal bottom wall 17. As can be seen in FIG. 1, the walls 12–17 are perpendicular to each other to form the parallelepipedic cabinet 11.

Mounted inside the cabinet 11 are an upper triangular partition wall 18 and a lower horizontal rectangular partition wall 19. The lower and upper partition walls 18 and 19 separate the inner volume of the cabinet 11 into a low frequency transducer compartment 25, a relatively thin, two-side open bottom compartment 20, and an upper mid-frequency transducer pyramidal compartment 33 situated in the inner, right top front corner 39 of the cabinet 11.

Referring to FIG. 1, the lower horizontal rectangular partition wall 19 is parallel to the bottom wall 17 and is slightly higher than this bottom wall 17. Partition wall 19 also comprises a first edge surface 40 glued to the inner face of the front wall 13, a second edge surface 41 glued to the inner face of the left side 14, a third edge surface 42 glued to the inner face of the rear wall 16, and a fourth edge surface 43 glued to the inner face of the right side wall 15. Therefore, the relatively thin bottom compartment 20 is delimited by the lower partition wall 19, the bottom wall 17, the front wall 13, the rear wall 16 and the left and right side walls 14 and 15.

Also, as illustrated in FIGS. 1 and 3, the low frequency transducer compartment 25 is delimited by the lower partition wall 19, the top wall 12, the front wall 13, the rear wall 16, the left and right side walls 14 and 15, and the upper triangular partition wall 18.

The upper partition wall 18 defines an equilateral triangle and is inclined at 45° from the horizontal. Also, this upper triangular partition wall 18 has a first bevelled edge surface 30 glued to the inner face of the top wall 12, a second bevelled edge surface 31 glued to the inner face of the front wall 13, and a third bevelled edge surface 32 glued to the inner face of the right side wall 15. Accordingly, the mid-frequency transducer pyramidal compartment 33 is delimited by the upper triangular partition wall 18, the front right portion of the top wall 12, the top front portion of the right side wall 15, and the top right portion of the front wall 13.

The lower partition wall 19 has a generally central circular hole (not shown) opening in the low frequency transducer compartment 25 to receive a low frequency transducer 21. The low frequency transducer 21 is mounted on the top face of the lower partition wall 19 and is facing downwardly to produce sound in the bottom compartment 20. In this position, the rear face of the cone 22, the frame 23 and the magnet 24 of the low frequency transducer 21 are lying into the low frequency transducer compartment 25. The bottom compartment 20 is provided with an elongate, generally oval and horizontally extending opening 26 made in the front wall 13, and with another elongate, generally oval and horizontally extending opening 27 made in the rear wall 16. The front and rear openings 26 and 27 allows the low-frequency sound produced by the low frequency transducer 21 in the relatively thin bottom compartment 20 to leave this compartment 20 and propagate through the room (not shown) in which the speaker 10 is disposed.

A mid-frequency transducer 28 is mounted on the outer face of the front wall 13 in a hole (not shown) made in this front wall 13 and opening in the pyramidal mid-frequency transducer compartment 33. More specifically, the mid-frequency transducer 28 is installed in the upper right portion 29 of the front wall. In this position, the rear face of the cone 34, the frame 35 and the magnet 36 of the mid-frequency transducer 28 are lying into the mid-frequency transducer pyramidal compartment 33. The upper triangular partition wall 18 is therefore interposed between the low frequency transducer 21 and the mid-frequency transducer 28. As the upper triangular partition wall 18 constitutes an air-tight partition between the low frequency transducer compartment 25 and the upper mid-frequency transducer pyramidal compartment 33, the rear face of the cone 34 of the mid-frequency transducer 28 is totally isolated from the rear face of the cone 22 of the low frequency transducer 21.

A high frequency transducer 37 is installed on the inner face of the front wall 13 in a hole (not shown) made in this front wall 13 and opening in the low frequency transducer compartment 25. The rear portion 38 of the high frequency transducer 37 is therefore lying into the low frequency transducer compartment 25 of the speaker cabinet 11.

To improve low-frequency performance of the low frequency transducer 21, a port tube 44 is mounted on the front wall 13. The port tube 44 passes through the front wall 13 and extends in the low frequency transducer compartment 25 to couple the low frequency transducer compartment 25 with the outside of the cabinet 11. The port tube 44 will allow the sound produced by the movement of the cone 22 of the low frequency transducer 21 inside the low frequency transducer compartment 25 to project outward to improve low bass sound.

In the low frequency transducer compartment 25, the triangular partition wall 18, the top wall 12, and the left and right side walls 14 and 15 are lined with damping material 45. In the mid-frequency transducer pyramidal compartment 33, the partition wall 18 and the upper wall 12 are also lined with damping material 46. "Acoustic fiberglass" or other acoustic material is often used as damping material such as 45 and 46. The damping material 45 and 46 will damp sound reflections; if too much sound is reflected back onto the midrange or low frequency transducer by the hard wall surfaces inside the cabinet 11, the music will seem boomy and unnatural.

A three-way crossover circuit 47 is mounted in a rectangular hole 48 made in the rear wall 16. The three-way crossover circuit 47 has connectors (not shown) for receiving the wires from a channel of an audio amplifier (not shown). The function of the three-way crossover circuit 47 is to divide the frequencies of the signal received from the amplifier into (a) low frequencies supplied to the low frequency transducer 21 through a pair of wires 49, (b) mid-frequencies supplied to the mid-frequency transducer 28 through a pair of wires 51, and (c) high frequencies supplied to the high frequency transducer 37 through a pair of wires 51.

Finally, four conventional mounting elements 52 are provided on the outer face of the front wall 13 to enable removable installation of a speaker grille (not shown).

Advantages of the speaker of FIG. 1

A first major advantage of the speaker 10 of FIG. 1 is that the triangular partition wall 18 totally isolates the mid-frequency transducer 28 from the displacement of air produced by the low frequency transducer 21 in the low frequency transducer compartment 25. This eliminates the distortion usually found in the sound reproduced through a mid-frequency transducer, and caused by the displacement of air generated by the movement of the cone of a low frequency transducer.

A second major advantage of the speaker 10 of FIG. 1 is that the compartment 33 is pyramidal. Tests have demonstrated that a mid-frequency transducer pyramidal compartment such as 33 with an apex situated behind the mid-frequency transducer 28 enables the mid-frequency transducer 28 to reproduce a much larger frequency range. FIGS. *2a* and *2b* of the appended drawings clearly show that a pyramidal cabinet such as 33 in FIG. 1 increases by some dB's (up to 4 dB's) the level of the sound reproduced by a same transducer in the frequency range 150–1500 Hz. The portion 100 of the curve of FIG. *2a* in this frequency range 150–1500 Hz is reproduced on FIG. *2b* to more clearly show the increase of sound level. Those of ordinary skill in the art know that over 80 dB, increasing the sound level by 3 dB means multiplying the power from the amplifier by 2. The pyramidal cavity 33 therefore produces mechanically an increase of sound level that is far from being negligible.

This amplification is a mechanical amplification caused by the sound reflections produced in the mid-frequency transducer pyramidal compartment 33 in particular in the apex 53 situated behind the mid-frequency transducer 28.

Therefore, with a pyramidal cavity, the power furnished by an audio amplifier to a mid-frequency transducer to reproduce sound at the same level is greatly reduced.

In a conventional three-way speaker, a crossover circuit normally supplies the frequencies 0–1500 Hz to the low frequency transducer. To further reduce the power required from the audio amplifier (not shown) to drive the speaker 10 of FIG. 1, the cutoff frequencies of the crossover circuit 47 can be shifted to supply to the low frequency transducer 21 only the frequencies 0–150 Hz and to the mid-frequency transducer 28 the frequencies 150–1500 Hz normally supplied to the low frequency transducer 21. Since the power consumed by a low frequency transducer is higher than the power consumed by a mid-frequency transducer to produce the same level of sound, this reduces considerably the level of power consumed by the speaker 10. An amplifier with lower power ratings can therefore be used to drive the speaker 10 while producing the same level of low-frequency sound. This is enabled by the pyramidal cavity 33 which mechanically improve the ability of the mid-frequency transducer 28 to reproduce the frequencies 150–1500 at a higher level.

Obviously, it is within the scope of the present invention to use other wall structures to form the pyramidal cavity 33 of the speaker 10.

Finally, it should be pointed out that mounting the mid-frequency transducer 28 in a separate, isolated compartment such as 33 enables the construction of a speaker 10 with a cabinet 11 of smaller volume.

Although the present invention has been described herein above with reference to a preferred embodiment thereof, this embodiment can be modified at will, within the scope of the appended claims, without departing from the spirit and nature of the subject invention.

What is claimed is:

1. A multi-way speaker comprising:

a set of transducers including a mid-frequency transducer, and a low frequency transducer; and a hollow speaker cabinet structure defining a mid-frequency transducer compartment, a low frequency transducer compartment isolated from the mid-frequency transducer compartment, a first hole opening in the mid-frequency transducer compartment for receiving the mid-frequency transducer, and a second hole opening in the low frequency transducer compartment for receiving the low frequency transducer, whereby, in operation, the isolated mid-frequency transducer compartment and low frequency transducer compartment isolate the mid-frequency transducer from a displacement of air produced by the low frequency transducer in the low frequency transducer compartment;

wherein:

the mid-frequency transducer compartment is a pyramidal compartment defining an apex situated generally behind the mid-frequency transducer;

the hollow speaker cabinet structure comprises an enclosure wall means, and an inner partition wall means mounted within the enclosure wall means for dividing the hollow speaker cabinet structure into the mid-frequency transducer compartment and the low frequency transducer compartment;

the enclosure wall means presents the general configuration of a parallelepiped and defines an inner corner, and the inner partition wall means comprises a triangular wall applied in said inner corner to define the mid-frequency transducer pyramidal compartment.

2. A multi-way speaker as recited in claim 1, wherein the enclosure wall means comprises first, second and third walls perpendicular to each other to form said inner corner, and wherein the triangular wall comprises a first beveled edge surface applied to an inner face of the first wall, a second beveled edge surface applied to an inner face of the second wall, and a third beveled edge surface applied to an inner face of the third wall.

3. A multi-way speaker as recited in claim 2, wherein the first beveled edge surface of the triangular wall is glued to the inner face of the first wall, the second beveled edge surface of the triangular wall is glued to the inner face of the second wall, and the third beveled edge surface of the triangular wall is glued to the inner face of the third wall.

4. A multi-way speaker as recited in claim 1, wherein said multi-way speaker is a three-way speaker, wherein said set of transducers further comprises a high frequency transducer, and wherein said hollow speaker cabinet structure further comprises a third hole opening in the low frequency transducer compartment for receiving the high frequency transducer.

5. A multi-way speaker as recited in claim 1, further comprising a crossover circuit for supplying an audio signal to the mid-frequency transducer and the low frequency transducer, said crossover circuit comprising:

means for supplying to the mid-frequency transducer frequency components of the audio signal situated in the frequency range 150–1500 Hz; and means for supplying to the low frequency transducer frequency components of the audio signal situated in the frequency range 0–150 Hz.

* * * * *